US005275350A

United States Patent [19]

Vignoni et al.

[11] Patent Number: 5,275,350

[45] Date of Patent: Jan. 4, 1994

[54] AUTOMATIC CONTROLLED AERATING DEVICE FOR CREEL

[76] Inventors: Cesare Vignoni, Via Oberdan 64, Brescia, Italy; Werner Schaub, Belchenstrasse 19, Riken (Svizzera), Switzerland

[21] Appl. No.: 882,931

[22] Filed: May 14, 1992

[51] Int. Cl.[5] ..... B65H 49/14

[52] U.S. Cl. ..... 242/131

[58] Field of Search ..... 242/131, 131.1; 15/301, 15/345

[56] References Cited

U.S. PATENT DOCUMENTS

| | | | |
|---|---|---|---|
| 3,150,845 | 9/1964 | Pool | 242/131 |
| 3,667,093 | 6/1972 | Culpepper, Jr. | 242/131.1 X |
| 3,690,586 | 9/1972 | Bock | 242/131 |
| 4,333,201 | 6/1982 | Rohner | 15/301 |
| 4,540,138 | 9/1985 | Gutschmit | 242/131 |
| 4,622,713 | 11/1986 | Ohashi et al. | 15/301 X |
| 4,784,349 | 11/1988 | Renwick et al. | 242/131 |
| 4,903,367 | 2/1990 | Brunner | 242/131.1 X |
| 4,948,067 | 8/1990 | Gutschmit | 242/131 |

FOREIGN PATENT DOCUMENTS

| | | | |
|---|---|---|---|
| 0335230 | 10/1989 | European Pat. Off. | 242/131 |
| 3833434 | 12/1989 | Fed. Rep. of Germany | 242/131 |

*Primary Examiner*—Stanley N. Gilreath
*Attorney, Agent, or Firm*—McGlew and Tuttle

[57] ABSTRACT

The invention refers to an automatic controlled aerating and humidifying device and for a creel with yarns directed to a textile machine. The invention includes an air conditioning unit (12) in coaxial position to a frame (10) carrying yarns and which is equipped with a device (17, 17*a*) to receive clean and humidified air coming from a centralized generator of fresh and humidified air and to supply it from one end to another end towards or through yarn bobbins or reels, and with a device (18) defining a chimney-like passage to suck used and dirty air from the bottom and move it away towards a filtering device.

7 Claims, 2 Drawing Sheets

AUTOMATIC CONTROLLED AERATING DEVICE FOR CREEL

FIELD OF THE INVENTION

The invention refers to a creel for support of yarn twisting bobbins or reels, and for feeding yarn from the twisting bobbins or reels to a textile machine. The machine receiving the yarn from the creel can be a circular knitting machine or the like.

BACKGROUND OF THE INVENTIONS

In numerous yarn treatments and in the machines employed to manufacture textile products it is usual to bear a multiplicity of yarn bobbins or reels on a rack structure, commonly called creel. The creel is adjacent to the textile machine to be fed, but at a short distance from it. It is also usual to lead the yarns of the twisting bobbins or reels to the textile machine both through thread guide eyes and through continuous tubular guides.

When yarns are taken and unwound by twisting bobbins or reels, they show a remarkable tendency to release fly and some lint which is undesirable for a lot of reasons. Fly and lint tend to contaminate the atmosphere and represent a significant risk for the health of the operators employed on machines.

In addition, fly may have a negative influence on textile machines and cause considerable accumulations which may affect the correct operation of textile machines or penetrate into the fabric during manufacture thus giving rise to fabric defects.

Therefore, it is necessary and convenient to remove fly and lint from the atmosphere in which the yarns to be fed to the textile machine are present.

An attempt in this way was proposed in GB-A-2,087,543. This present publication proposes to remove any lint from yarns by blowing a current of air on the yarns themselves and by placing a filtering shield into the creel. However, such an execution involves some disadvantages as it requires a substantially closed environment for yarn twisting bobbins or reels. Consequently, the air to be blown on the yarns must be controlled and directed to the filter. Furthermore, the operation in a closed environment is often unsatisfactory as the casing defining the environment represents an obstacle for access and easy replacement of yarn twisting bobbins. In addition, the filtering shield needs a regular cleaning. The presence of a casing makes cleaning difficult, too. Furthermore, the cleaning of the filtering shield implies a waste of time and productivity as the machine cannot work during cleaning operations, with a considerable drop in its performances. On the other hand, if the filter is not clean, the whole installation becomes inefficient. The cleaning time should be eliminated by removing filters or obstructions within the creel.

The above mentioned patent publication also proposed to increase the humidity content during yarn unwinding from the twisting bobbin or reel by spraying some water by means of an atomization nozzle on the yarn itself, while it is leaving the twisting bobbin. Such humidification may reduce the ability of the yarn to carry static electricity and also reinforce yarns by slightly modifying cells and structure of fibers.

However, the present applicants have ascertained that water spraying on yarns through an atomization nozzle is an unsatisfactory and inefficient method to increase the humidity content of yarns themselves. As a matter of fact, it ensures a poor control of the humidity content of yarns, and the filtering shield gets obstructed even more rapidly because of humidity and wet fly.

In practice, along with all previous attempts to remove fly from yarns and increase the yarn humidity content, the adoption of a casing around the whole creel structure is an essential element of the above mentioned patent publication.

Other documents, such as EP-0,335,230, DE-3,833,434 and U.S. Pat. No. 4,784,349, refer to a creel with a fly removal system also with closed structure. The document EP-0,305,818 describes a creel with partially open structure, while further documents, such as EP-0,160,231 and U.S. Pat. No. 4,948,067, refer to creels with open construction with air circulation, with or without filtering shield. Therefore, it is evident that the well-known constructions are unsatisfactory for a lot of aspects. In fact:

- they have difficult access for operators when their structure is closed;
- they may be harmful to the operator's health, as some creel constructions blow the lint into work environments;
- they are inefficient, as the filtering shield, when present, gets obstructed rapidly;
- they are not very economical, as the time required to clean filters can also exceed 10% of the working time of a machine, even more in presence of singed yarns;
- in some cases, their operation is complicated, e.g., it is necessary to have the yarn ends passed behind the standards supporting bobbins;
- the creels equipped with a device to increase air humidity content around twisting bobbins or reels can only be controlled with difficulty and tend to get obstructed or to have an excess flow.

SUMMARY AND OBJECTS OF THE INVENTION

The present applicants are convinced that only a creel construction, which is able to get through all above mentioned problems, may have success in practice. A creel should have a simple but sturdy construction, it should have an easy operation, without any idle times for cleaning and it should avoid scattering lint in the atmosphere. Its air flow should be constant, air flow and humidity should be entirely controllable. Its structure should be laterally as open as possible for an easy access to yarn bobbins or reels.

To obtain all these aspects, the present invention proposes a creel which can be circular, quadrilateral and of any other possible form, comprising a frame consisting of a plurality of standards with arms to bear yarn bobbins or reels.

Other characteristics of the invention regard the structure of the air conditioning unit on the pressure chamber level and the arrangement of the arms supporting bobbins or reels.

Further details about the invention will be more evident in the description below which refers to the enclosed drawings, even if schematic and only indicative, in which:

DETAILED DESCRIPTION OF THE DRAWINGS

Figure 1:
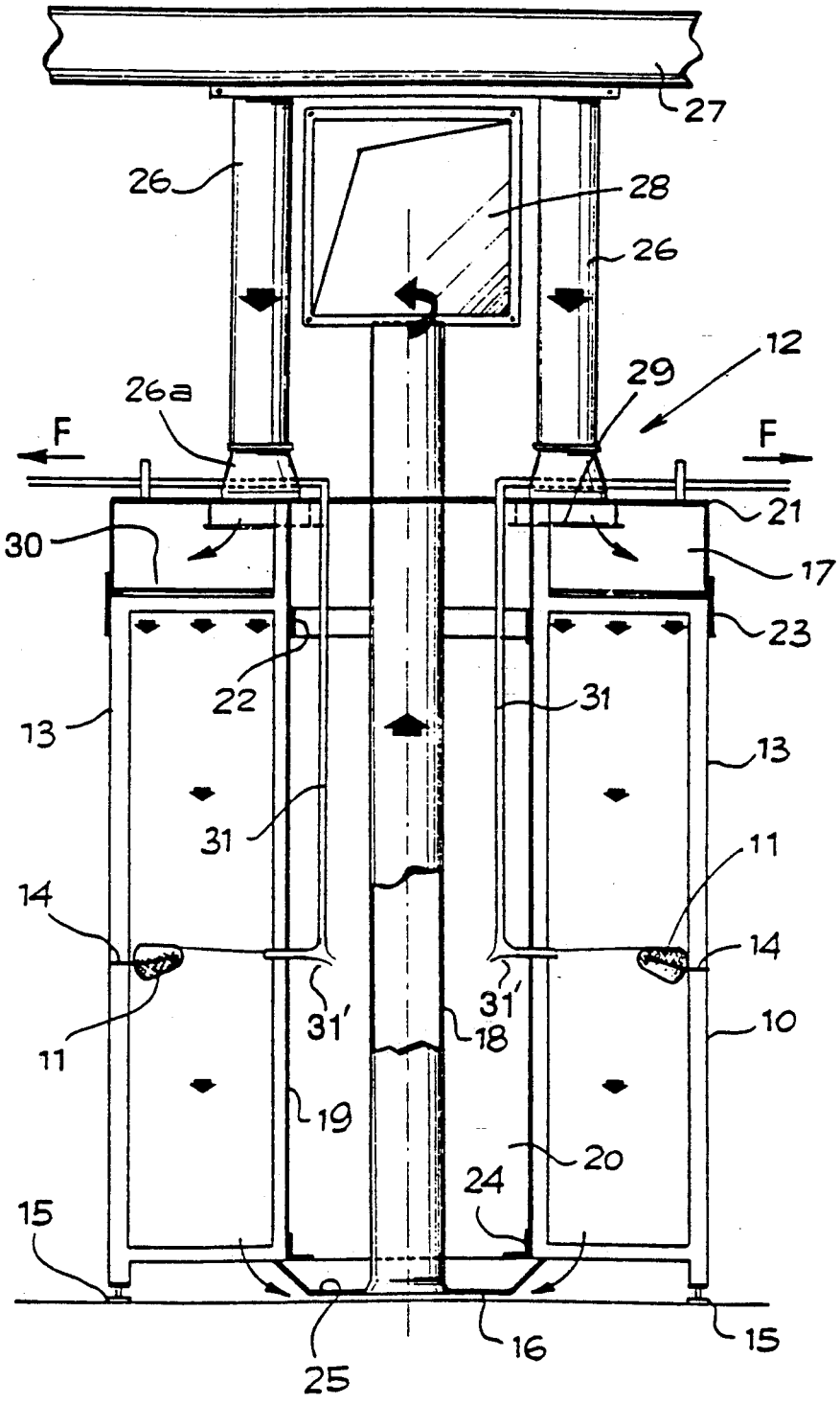
FIG. 1 shows the creel according the invention in partial vertical section.

The creel proposed essentially comprends a frame 10 intended for bearing yarn bobbins or reels 11 and a supply from an air conditioning unit an air supply means 12 placed in coaxial position to the frame.

This frame 10 comprends some standards 13; each one carries a series of arms 14 supporting the yarn bobbins or reels 11 shown in reduced number in the drawings. In addition, it is equipped with feet 15 resting on the floor and has an adjustable height to attain a creel leveling and to keep the lower side of the air conditioning unit an air supply means 12 slightly raised from the floor. This facilitates the floor cleaning. This way, it is possible to create between the floor and the unit 12 an air inlet opening 16 from the bottom of the unit itself.

The conditioning unit includes an annular pressure chamber or distribution means 17 on the top of the frame 10, a central duct means 18 rising in the manner of a chimney starting from the opening 16 on the floor level, and a tubular casing 19 placed around the rising duct and delimiting, along with the latter one, an annular space 20. The tubular casing 19 is located at the center of the creel considering the arrangement of the standards 13 with arms 14 supporting the bobbins 11, so as to leave always free and immediate access to the bobbins.

Figure 2:
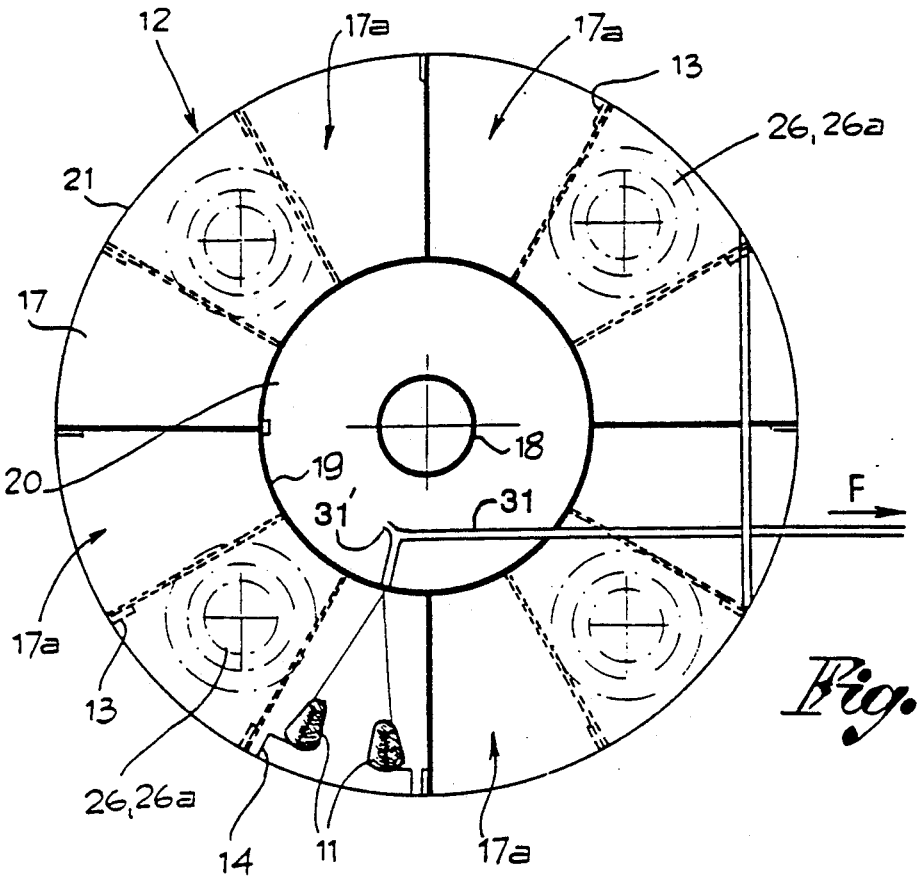
FIG. 2 shows a top view of the creel in FIG. 1.

The annular chamber 17 is defined by a body 21 placed and fastened, by means of internal and external reinforcement rings or other means, respectively 22 and 23, to the frame top 10 to occupy, in the space, a crown lying above the yarn bobbins or reels. As shown in FIG. 2, it can be subdivided into several sectors or compartments 17*a* by means of partitions fixed in said body 21. The rising central duct 18 is fastened below to a reinforcement ring 24, applied on the frame 10, closed by bottom means 25. The annular space 20 is defined between the central duct and the casing 19. The lower mouthpiece, towards the floor, of the duct itself remains free. In its turn, the casing 19 is fastened to the lower reinforcement rings 24 and to the upper ones 22.

The annular pressure chamber 17 or, better, each distribution sector or compartment 17*a* in which it is subdivided, is connected to a conduit 26 for the supply of fresh, clean and humidified air coming from an air duct 27. The air duct 27 depends on a central station for fresh air production/supply and the central station is equipped with a fan and humidifying device. In its turn, the central duct 18 leads, on the top, into a channel 28 for the exhaust of used and dirty air which rises from the opening 16 adjacent to the floor and extends towards a filtering device—not shown in the figures.

More precisely, each conduit 26 is connected to the chamber, that is to the respective compartment 17*a*, through a flared feeder 26*a* incorporating a pierced shield 29 which is crossed by fresh air. The lower wall of the body 21 delimiting the chamber 17 and, consequently, the sectors or compartments 17*a* in which it is subdivided, also consists of a pierced plate 30 enabling air to flow from the top to the bottom in the creel and to hit or some in contact with the yarns.

The air flow to the sectors or compartments 17*a* through the feeders 26*a*, and the air flow from the sectors or compartments to the bottom are adjusted so as to enable yarns to be hit by or interact with a constant laminar calm air flow on the whole creel height according to the principle of a forced displacement free from any turbulence caused by currents of air. Then, the current of air, coming from the centralized device through the air duct 27, passes into the sectors or compartments 17*a* of the pressure chamber 17 and is exhausted from the latter one towards the bottom through the pierced plate so as to hit or flow past the yarns. The used air is sucked from the bottom by means of a rising duct 18 and moved away towards the filtering device.

Therefore, it is evident that fresh air can be prepared in a centralized position, maintained and distributed in the desired humidity conditions. It is also evident that the used air is moved away, while it carries any fly and lint set free by yarns, so as to attain the above mentioned advantages.

The yarns unwound by the bobbins or reels 11 are led into the direction of the arrow F towards the textile machine to be fed—not shown in the figures—by means of guide tubes 31 or means positioned partially in chamber 20, as one can infer, even if schematically, from FIG. 1 and FIG. 2 in the drawing.

These tubes 31 can be provided with a mouthpiece 31' to inject the air of the chamber 20. In this case, the tubes 31 can guide humid air with the double function of humidifying yarns in their run from the creel to the textile machine and of facilitating the yarn sliding in the tube.

Figure 3:
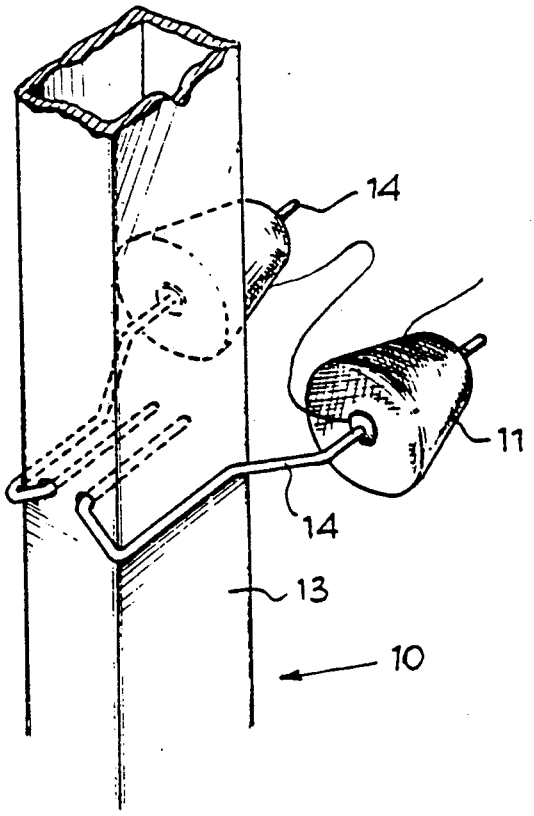
FIG. 3 shows a perspective view of a preferred arrangement of the arms supporting yarn twisting bobbins or reels.

FIG. 3 shows the arrangement of the arms 14 supporting the twisting bobbins or reels 11. Each standard 13 of the creel frame 10 carries two rows of supporting arms 14 on two opposite sides to the right and to the left of the standard itself. The arms 14 can turn about mounting holes in the standard, during use, a portion of the arms 14 rest against a side of the standard 13. The arms 14 can be rotated upward or away from the standard 13 in order to give plenty of room to install and remove the arms 14. This, along with their arrangement, facilitates the loading of yarn twisting bobbins or reels. In addition, the arm on the left of one standard is arranged on the same level as an arm on the right of the standard. The yarn tail of one bobbin on one arm can then be connected to the yarn end of the bobbin on the other arm, as shown in FIG. 3, without having to pass behind the standard thus assuring work comfort to operators and a better functionality in the yarn arrangement.

While a specific embodiment of the invention has been shown and described in detail to illustrate the application of the principles of the invention, it will be understood that the invention may be embodied otherwise without departing from such principles.

We claim:

1. A creel comprising:

air supply means for supplying a clean and humidified air flow along an axis, said air supply means including an annular distribution means for distributing the clean and humidified air in a substantially annular flow, said air supply means also including a conduit means for leading the clean and humidified air from a centralized generator to said annular distribution means;

a plurality of standards having a first end positioned adjacent said air supply means and extending from said first end to a second end in a direction of the air flow, said standards being angularly spaced around the axis;

a plurality of arms mounted on said plurality of standards, said arms positioning bobbins in the air flow;

guide tube means for guiding thread off of the bobbins, through the air flow and away from the creel; and central duct means for receiving the air flow from said second end of said plurality of standards after the air flow has passed the bobbins and said central duct means moving the received air flow to a filtering device, said central duct means having a first end positioned in a substantial center of said annular distribution means and axially extending with said plurality of standards to a second end adjacent said second ends of said plurality of standards, said second end of said central duct means receiving the air flow, said central duct means also including an exhaust channel.

2. A creel in accordance with claim 1, wherein:

said annular distribution means includes a plurality of distribution sectors and a plurality of said conduit means, each of said plurality of distribution sectors being connected to one of said plurality of conduit means, each conduit means including a flared feeder faced to a respective distribution sector and incorporating a pierced shield crossed by the clean and humidified air, said annular distribution means having a side adjacent to said standards and including pierced plate means for exhausting the clean and humid air in a laminar form toward the bobbins.

3. A creel in accordance with claim 1, wherein:

said second end of said standards and said central duct means are positioned adjacent a floor surface, said central duct means receiving the air flow from adjacent the floor; and said standards include adjustable feet means for adjusting a distance between the floor and said second end of said central duct means.

4. A creel in accordance with claim 1, wherein:

said guide tube means includes a guide tube and a mouthpiece for injecting humid air from an inner part of the creel into said guide tube.

5. A creel comprising:

air supply means for supplying a clean and humidified air flow along an axis;

a plurality of standards having a first end positioned adjacent said air supply means and extending from said first end to a second end in a direction of the air flow, said standards being angularly spaced around the axis;

a plurality of arms mounted on said plurality of standards, said arms positioning bobbins in the air flow;

guide tube means for guiding thread off of the bobbins, through the air flow and away from the creel;

central duct means for receiving the air flow from said second end of said plurality of standards after the air flow has passed the bobbins and said central duct means moving the received air flow to a filtering device; and a tubular casing substantially concentric with said central duct means and defining a chamber between said tubular casing and said central duct means, said guide means having a portion positioned in said chamber.

6. A creel comprising:

air supply means for supplying a clean and humidified air flow along an axis;

a plurality of standards having a first end positioned adjacent said air supply means and extending from said first end to a second end in a direction of the air flow, said standards being angularly spaced around the axis;

a plurality of arms mounted on said plurality of standards, said arms positioning bobbins in the air flow, two of said plurality of arms are positioned on substantially opposite sides of one of said standards, each of said arms being rotatably mounted on said one standard, said each arm being rotatable between a position where a portion of said arm is in contact with a side of said standard and another position where said portion of said arm is positioned away from said side of said standard;

guide tube means for guiding thread off of the bobbins, through the air flow and away from the creel; and central duct means for receiving the air flow from said second end of said plurality of standards after the air flow has passed the bobbins and said central duct means moving the received air flow to a filtering device.

7. A creel in accordance with claim 6, wherein:

said guide tube means includes a guide tube and a mouthpiece, said mouth piece injects humid air from said chamber into said guide tube.

* * * * *